US005489224A

United States Patent [19]

Schwarz

[11] Patent Number: 5,489,224

[45] Date of Patent: Feb. 6, 1996

[54] HOODED ELECTRICAL CONNECTOR WITH TERMINAL POSITION ASSURANCE MEANS

[75] Inventor: Uwe Schwarz, Ettlingen, Germany

[73] Assignee: Molex Incorporated, Lisle, Ill.

[21] Appl. No.: 323,654

[22] Filed: Oct. 17, 1994

[30] Foreign Application Priority Data

Nov. 26, 1993 [EP] European Pat. Off. ..... 93119069

[51] Int. Cl.[6] ..... H01R 13/436

[52] U.S. Cl. ..... 439/752; 439/466

[58] Field of Search ..... 439/595, 752, 439/466, 473

[56] References Cited

U.S. PATENT DOCUMENTS 4,082,400 4/1978 Gansert ..... 439/341
4,200,350 4/1980 Zimmerman ..... 439/357
5,282,760 2/1994 Aimasso ..... 439/752
5,403,212 4/1995 Aimasso .

FOREIGN PATENT DOCUMENTS 0510583 4/1992 European Pat. Off. .

*Primary Examiner*—Gary F. Paumen
*Attorney, Agent, or Firm*—A. A. Tirva

[57] ABSTRACT

An electrical connector includes a housing having a plurality of terminal-receiving passages extending between a forward mating end of the housing and a rear end thereof. A plurality of terminals are received in the passages. A terminal position assurance device is mounted on the housing for movement between first and second positions only when all of the terminals are properly positioned in their respective passages. A cover is securable to the housing over at least a portion of the rear end thereof. The terminal position assurance device has a portion which prevents securing the cover to the housing unless the terminal position assurance device is in its second position.

3 Claims, 7 Drawing Sheets

HOODED ELECTRICAL CONNECTOR WITH TERMINAL POSITION ASSURANCE MEANS

FIELD OF THE INVENTION

This invention generally relates to the art of electrical connectors and, particularly, to an electrical connector which includes a hood or cover which cannot be secured to the connector unless a terminal position assurance device is properly positioned.

BACKGROUND OF THE INVENTION

"Hooded" electrical connectors generally include a connector housing having a plurality of terminal-receiving passages extending between a forward mating end of the housing and a rear end thereof. A plurality of terminals are received in the passages, and the terminals are connected to a multi-wire cable which extends away from the rear end of the connector. A cover or hood covers or encloses the rear end of the connector about the terminated end of the multi-wire cable.

On the other hand, terminal position assurance devices are known for use in electrical connectors to assure that all of the terminals are properly positioned within the connector housing. Basically, a terminal position assurance device is movable between a first position and a second position. The device can move to the second position only when all of the terminals are properly positioned in their respective passages. If even a single terminal is not properly positioned, the terminal position assurance device cannot move away from its first position. Such a device often is used to prevent mating of a connector with a complementary connector unless the terminal position assurance device is moved to its second or enabling position. A problem with such systems is that an operator often does not discover that one or more terminals are not properly positioned until attempts are made to mate the connector. At that time, "defective" connectors simply are wastefully discarded.

The present invention is directed to a unique system wherein the hood or cover of an electrical connector cannot be assembled or secured to the connector housing unless all of the terminals within the housing are in their respective proper positions, i.e. until the terminal position assurance device is moved to its second or enabling position. Therefore, an improperly positioned terminal will be detected at the early stage of assembling the hooded connector.

SUMMARY OF THE INVENTION

An object, therefore, of the invention is to provide a new and improved hooded electrical connector with a terminal position assurance means.

In the exemplary embodiment of the invention, the connector includes housing means having a plurality of terminal-receiving passages extending between a forward mating end of the housing means and a rear end thereof. A plurality of terminals are received in the passages. A terminal position assurance device is mounted on the housing means for movement between first and second positions only when all of the terminals are properly positioned in their respective passages. A hood or cover is secured to the housing means over at least a portion of the rear end thereof.

The invention contemplates that the terminal position assurance device include means to prevent securing the cover to the housing unless the terminal position assurance device is in its second position. As disclosed herein, the terminal position assurance device includes a first portion operatively associated with the terminals such that the device can move to its second position only when the terminals are properly positioned. The device includes a second portion operatively associated with the cover such that the cover can be secured to the housing only when the device is in its second position.

Specifically, the first portion of the terminal position assurance device comprises a plate slidably mounted on the connector housing means. The plate has a plurality of apertures through which the terminals extend. The second portion of the terminal position assurance device comprises an arm projecting from the plate into a path of movement of the cover into securing position on the housing means when the device is in its first position. Specifically, the cover is secured to the housing means by rib means on the cover positionable into groove means on the housing means. The arm of the terminal position assurance device blocks the groove means when the device is in its first position, but the arm allows the rib means to enter the groove means when the device is in its second position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
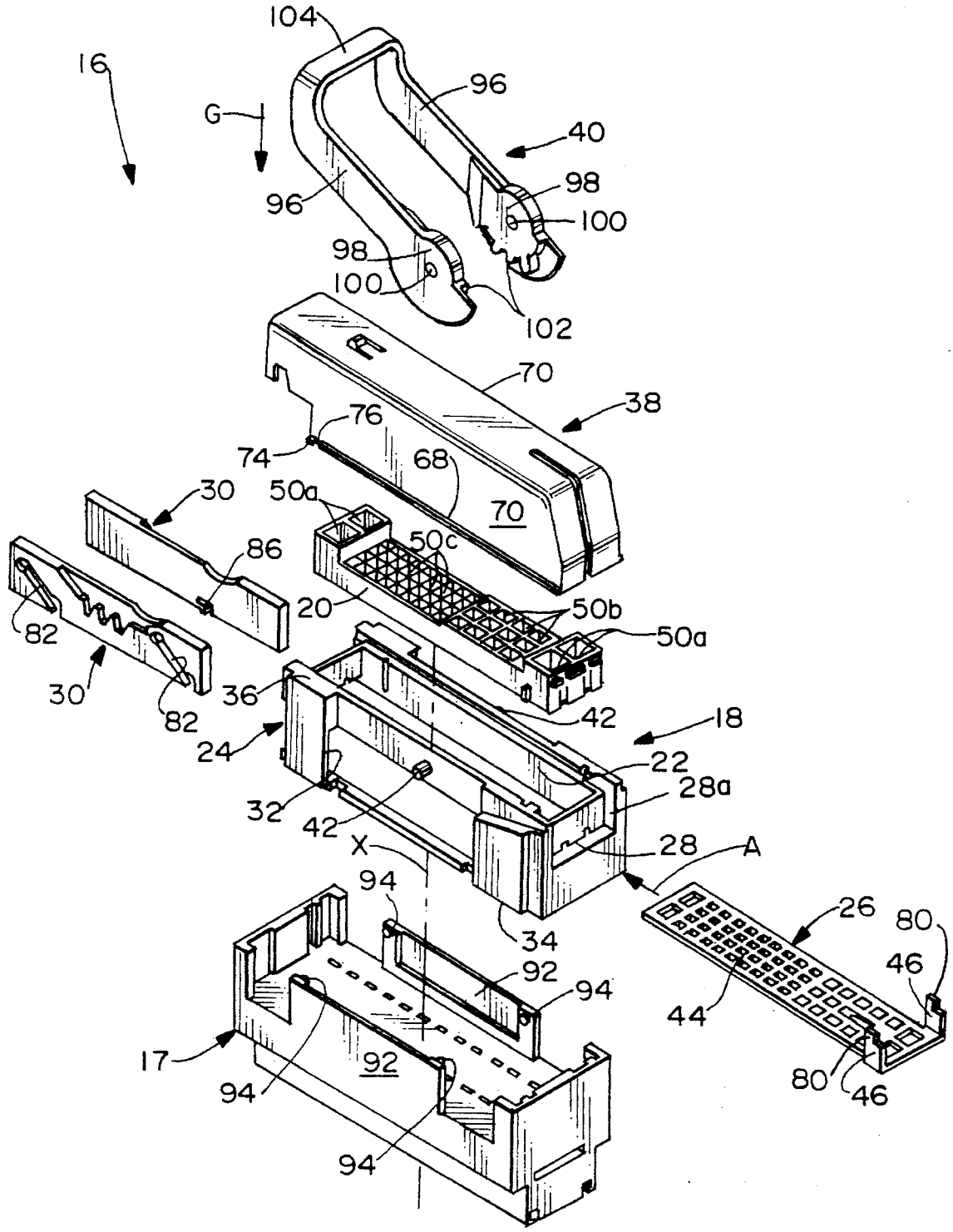
FIG. 1 is an exploded perspective view of a hooded electrical connector embodying the concepts of the invention, along with a housing portion of a complementary mating connector.

Referring to the drawings in greater detail, and first to FIG. 1, the invention is embodied in a hooded electrical connector, generally designated 16, which is shown in conjunction with a housing, generally designated 17, of a complementary mating connector. The entirety of the mating connector is not shown in the drawings. The connectors define a mating axis "X".

Generally, hooded electrical connector 16 includes housing means, generally designated 18, which include a terminal block 20 positionable within a cavity 22 of a receptacle housing part, generally designated 24. A terminal position assurance device, generally designated 26, is slidably received in a horizontal slot 28 in one end of housing part 24. A pair of lock slides, generally designated 30, are slidably received within a pair of vertical slots 32 on opposite sides of housing part 24, all for purposes to be described hereinafter. Housing part 24 defines a forward mating end 34 and a rear end 36 which is substantially covered by a hood or cover, generally designated 38. A one-piece locking lever, generally designated 40, is pivoted on a pair of pivot pins 42 projecting outwardly from the sides of housing part 24, again for purposes described hereinafter.

Figure 2:
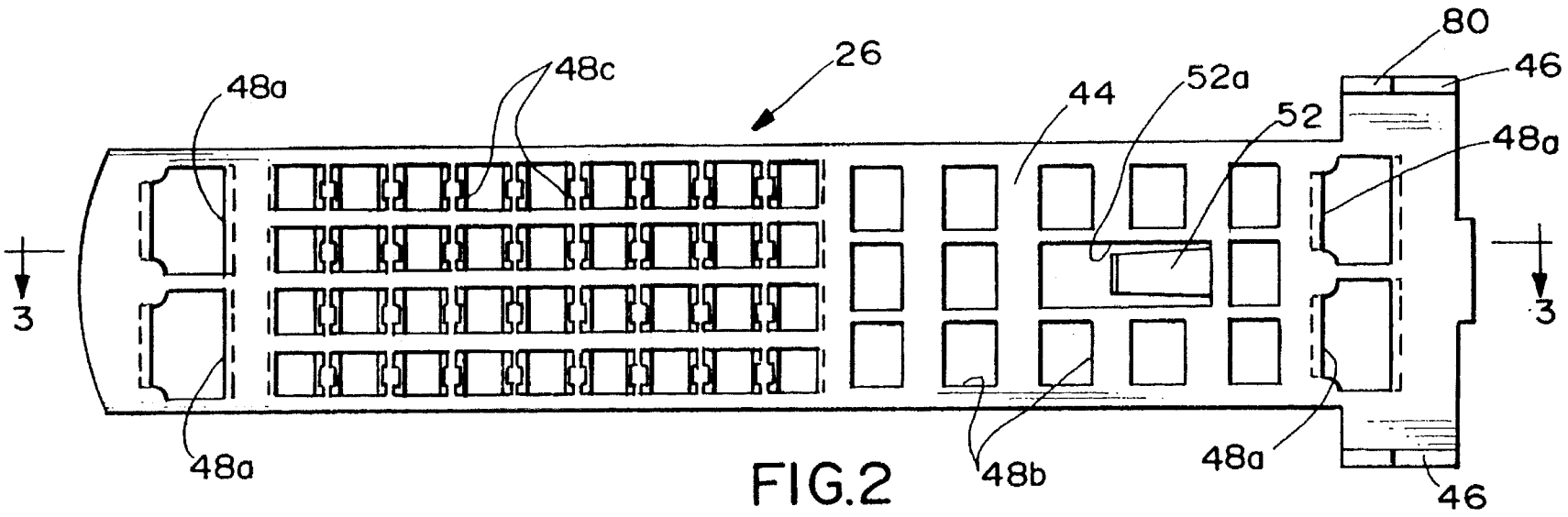
FIG. 2 is a plan view of the terminal position assurance device.
Figure 3:
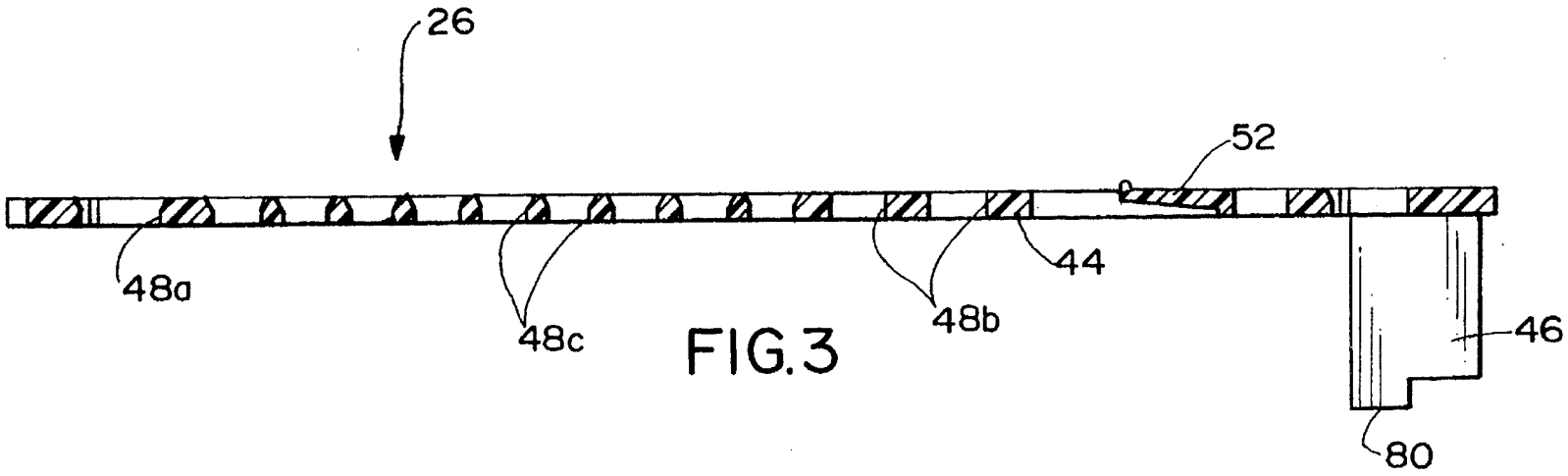
FIG. 3 is a section taken generally along line 3—3 of FIG. 1.

Referring to FIGS. 2 and 3 in conjunction with FIG. 1, terminal position assurance device 26 has a first or plate portion 44 and a pair of second or arm portions 46 projecting laterally from the plate portion. The plate portion has a plurality of apertures 48*a*, 48*b* and 48*c* which are of different sizes and which correspond to a plurality of terminal-receiving passages 50*a*, 50*b* and 50*c*, respectively, in terminal block 20 of housing means 18 described above in relation to FIG. 1. A latch 52 is formed in a cut-out 52*a* in plate portion 44 of the terminal position assurance device. Plate portion 44 is inserted into slot 28 (FIG. 1) of housing part 24 in the direction of arrow "A", and arms 46 are positionable into a pair of vertical slot portions 28*a* which communicate with slot 28.

Figure 4:
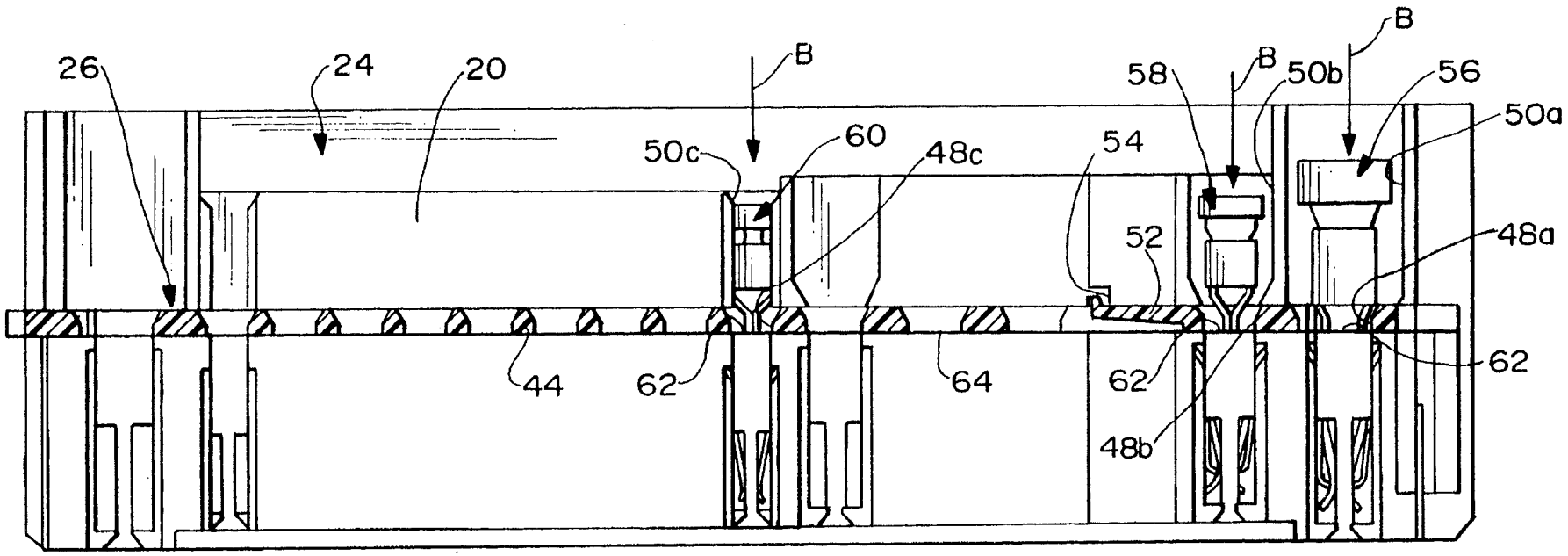
FIG. 4 is a section through the connector housing with the terminal position assurance device in its first position.
Figure 5:
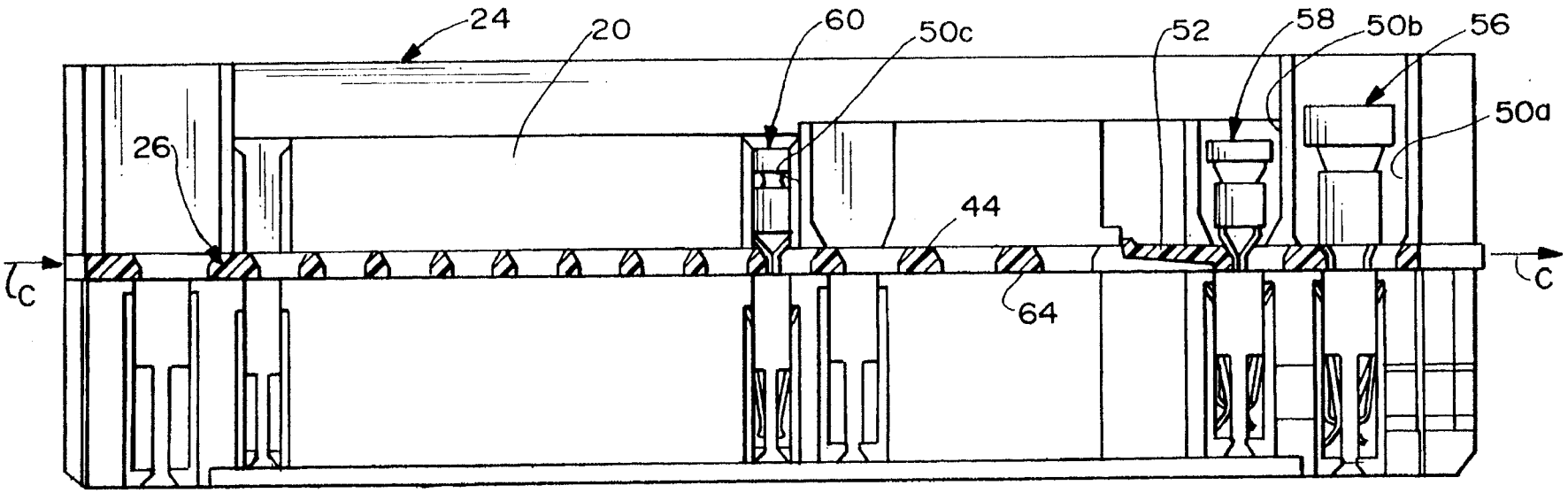
FIG. 5 is a view similar to that of FIG. 4, with the terminal position assurance device in its second or enabling position.

Referring to FIGS. 4 and 5 in conjunction with FIGS. 1–3, FIG. 4 shows terminal position assurance device 26 in its first position defined by latch 52 engaging within a shoulder 54 of terminal block 20. Some of the terminals of the connectors are shown in their respective terminal-receiving passages, namely: a large terminal, generally designated 56, is shown in one of the terminal-receiving passages 50*a*; an intermediate size terminal, generally designated 58, is shown in one of the terminal-receiving passages 50*b*; and a small terminal, generally designated 60, is shown in one of the terminal-receiving passages 50*c*. Terminals 56, 58 and 60 project through respective ones of the apertures 48*a*, 48*b* and 48*c*, respectively, of terminal position assurance device 26. It can be seen that each of the terminals 56–60 has a necked-down portion which defines a shoulder 62 on each terminal. The terminals are inserted into the terminal-receiving passages in the direction of arrows "B". When the terminals are fully or properly positioned within their respective terminal-receiving passages, shoulders 62 of all of the terminals are located at least below a bottom surface 64 of terminal position assurance device 26.

Therefore, and referring to FIG. 5, if all of the terminals 56–60 are fully or properly inserted into their respective terminal-receiving passages, such that shoulders 62 of the terminals are below bottom surface 64 of terminal position assurance device 26, the device can be moved in the direction of arrow "C" (FIG. 5). This second position of the device can be considered the enabling position for securing cover 38 to housing means 18 as described below.

Figure 6:
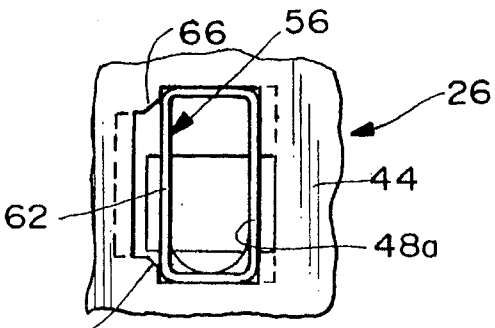
FIG. 6 is a fragmented plan view of a single aperture in the terminal position assurance device surrounding a terminal, the device being in its first position.
Figure 7:
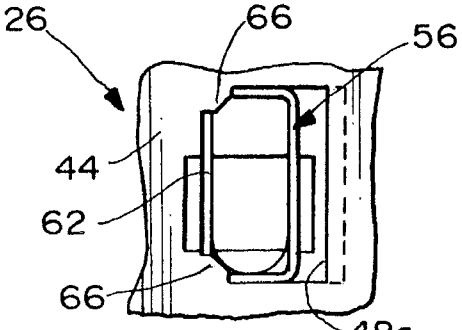
FIG. 7 is a view similar to that of FIG. 6 with the terminal position assurance device in its second position.

However, before proceeding to the structure for securing cover 38, reference is made to FIGS. 6 and 7 which show a single aperture (e.g. 48*a*) in plate portion 44 of terminal position assurance device 26 in relation to a terminal 56 which extends through the aperture. FIG. 6 corresponds to the first position of the terminal position assurance device as shown in FIG. 4, and FIG. 7 shows the position of the device corresponding to the depiction in FIG. 5. It can be seen that the aperture 48*a* has a pair of ears 66 which extend over the shoulder 62 of terminal 56 when the terminal position assurance device is in its second position. Therefore, the device acts as a lock to prevent the terminals from backing out of their respective terminal-receiving apertures.

Figure 8:
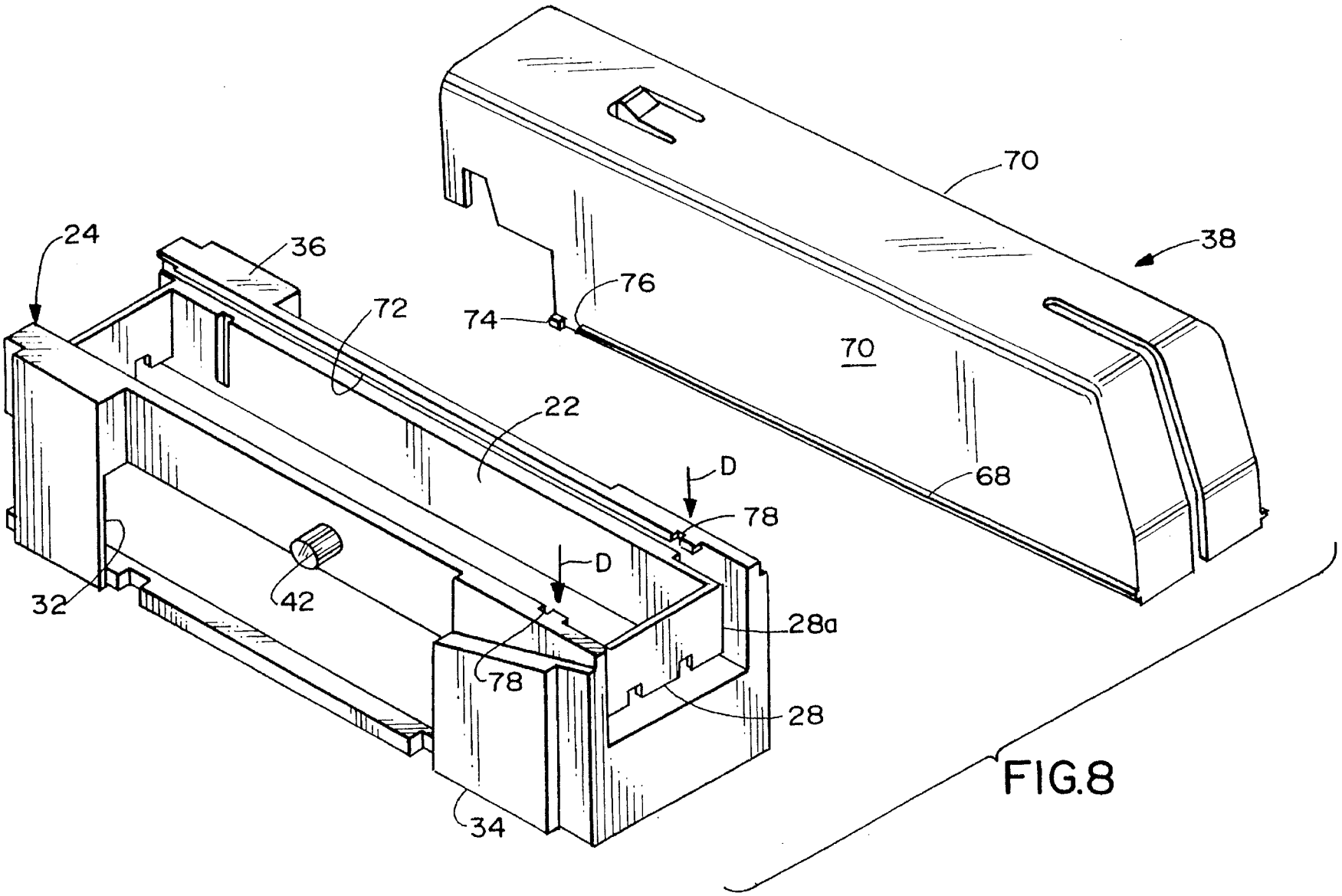
FIG. 8 is an exploded perspective view of the housing (without the terminal block and the terminal position assurance device), along with the cover located in position for assembly to the housing.

Referring to FIG. 8, hood or cover 38 is secured to housing part 24 by a pair of ribs 68 extending longitudinally along the bottom outside edges of a pair of side walls 70 of the cover, the ribs being slidably received within a pair of grooves 72 on the inside of the opposite sides of housing part 24 and extending lengthwise thereof. An enlarged rib boss 74 is separated from rib 68 by a gap 76. As will be seen in greater detail hereinafter, rib boss 74 is thicker than rib 68. Still referring to FIG. 8, a pair of vertical access openings 78 are formed in housing part 24, in communication with grooves 72, and through which enlarged rib bosses 74 can be inserted in the direction of arrows "D" to horizontally align both the enlarged rib bosses 74 and ribs 68 with grooves 72 in housing part 24.

Figure 9:
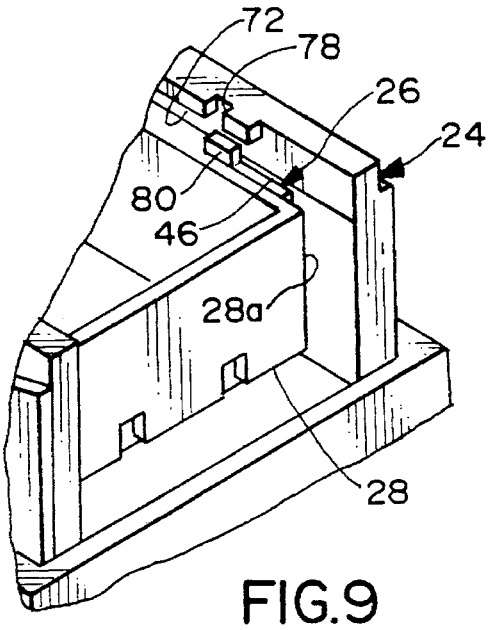
FIG. 9 is a fragmented perspective view of the housing, with the terminal position assurance device in its first or inoperative position.
Figure 10:
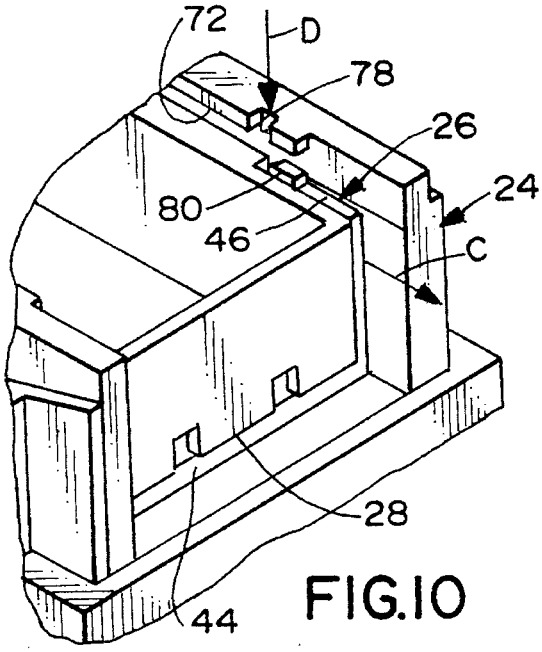
FIG. 10 is a view similar to that of FIG. 9, with the terminal position assurance device in its second or enabling position.

Referring next to FIGS. 9 and 10, one of the grooves 72 in housing part 24 is shown with its respective vertical access opening 78, and in conjunction with terminal position assurance device 26. One of the arm portions 46 of the terminal position assurance device is visible in FIGS. 9 and 10, along with a blocking tab 80 which projects upwardly therefrom. The terminal position assurance device is shown in FIG. 9 with blocking tab 80 generally in alignment with access opening 78 to block the opening. This represents the first or "blocking" position of the terminal position assurance device. FIG. 10 shows the terminal position assurance device having been moved in the direction of arrow "C" to its second or enabling position. It can be seen that blocking tab 80 now has been moved away from access opening 78 so that the respective rib boss 74 (FIG. 8) can be inserted therethrough in the direction of arrow "D".

Figure 11:
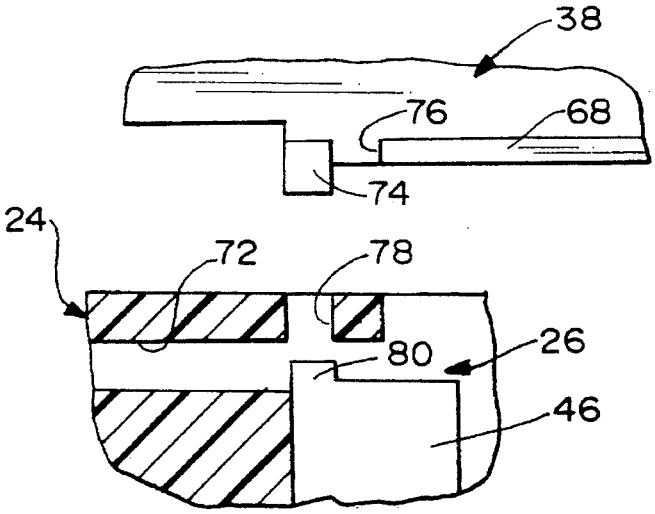
FIG. 11 is a somewhat schematic, exploded illustration of the rib and groove means on the cover and the housing, along with the terminal position assurance device in its first or blocking position.
Figure 12:
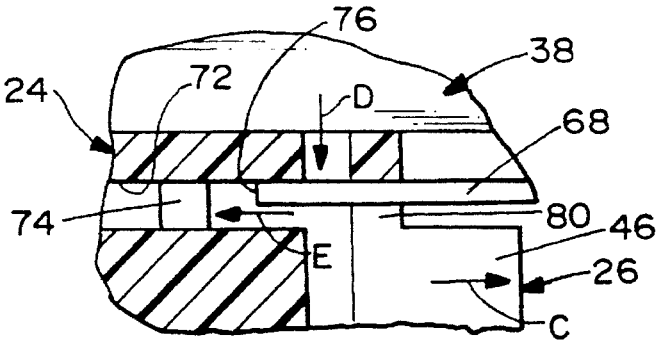
FIG. 12 is a view similar to that of FIG. 11, with the terminal position assurance device in its second or enabling position, along with the rib means of the cover received in the groove means of the housing.

Now referring to the somewhat schematic illustrations of FIGS. 11 and 12, FIG. 11 shows terminal position assurance device 26 with one of the blocking tabs 80 on its respective arm 46 in position blocking access opening 78 to slot 72 on one side of housing part 24. Cover 38 also is shown with its enlarged rib boss 74 in alignment with access opening 78. However, it can be understood that rib boss 74 cannot be inserted through access opening 78 in registry with slot 72, because tab 80 on the terminal position assurance device is blocking access to the slot. It also can be understood from FIG. 11 why rib boss 74 is considered "enlarged", namely it is thicker than rib 68, as shown.

Now, turning to FIG. 12, it can be seen that terminal position assurance device 26 has been moved to its second or enabling position in the direction of arrow "C", whereby blocking tab 80 no longer blocks access opening 78, and whereby enlarged rib boss 74 of the cover can be inserted through the access opening in the direction of arrow "D". The cover then can be secured to the housing part by sliding enlarged rib boss 74 and rib 68 in groove 72 in the direction of arrow "E". It can be seen in FIG 12 that, with rib 68 being thinner than the enlarged rib boss 74, the rib can slide within groove 72 above blocking tab 80 of terminal position assurance device 26, when the device is in its second position which indicates that all of the terminals are properly positioned within the connector.

Figure 13:
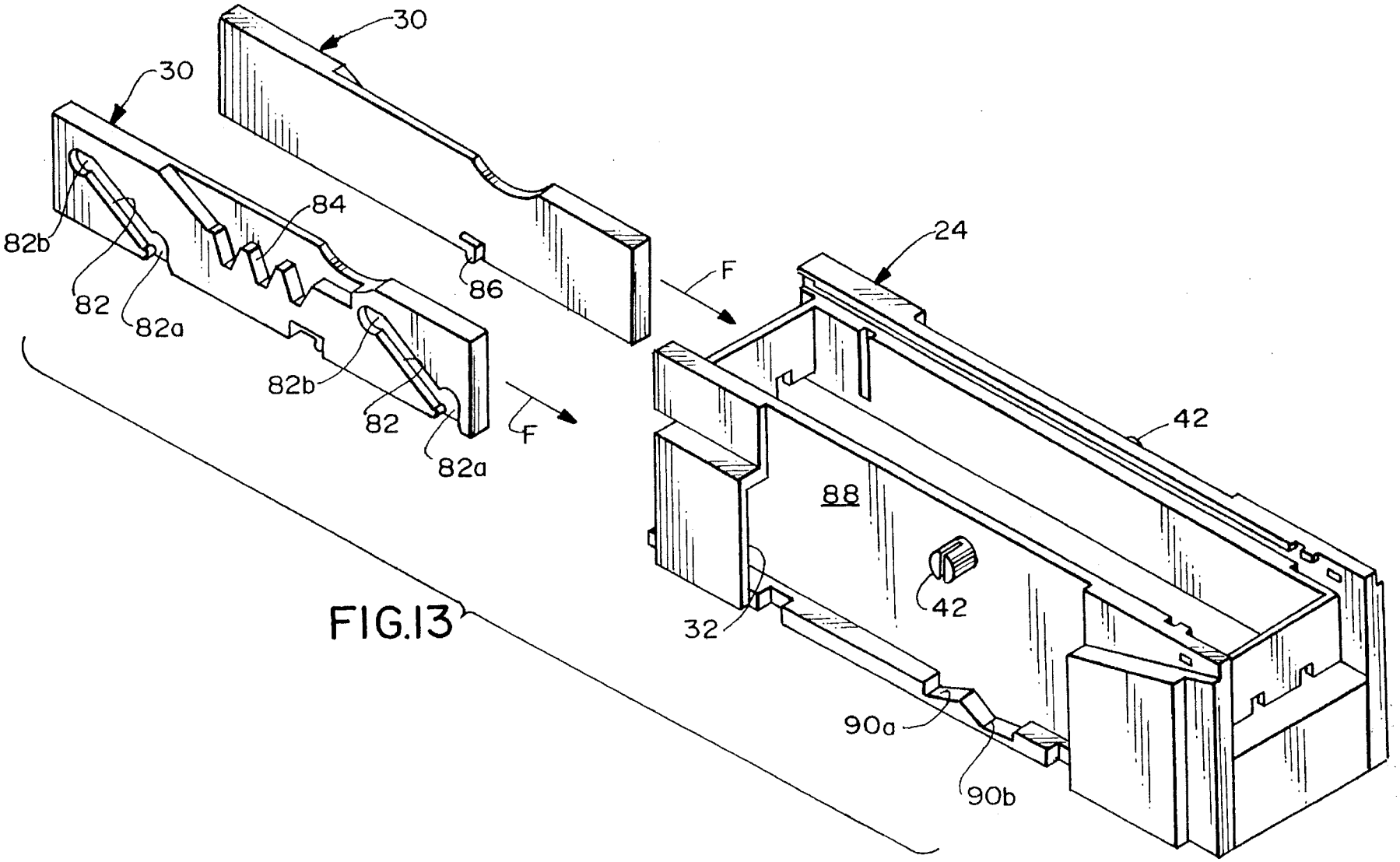
FIG. 13 is an exploded perspective view of the housing means and the lock slides for engaging the complementary connector housing.

Referring to FIG. 13 in conjunction with FIG 1, the invention contemplates a camming system for mating and unmating connector 16 (FIG. 1) and a complementary connector which includes housing 17. It can be seen in FIG. 13 that each lock slide 30 has a pair of cam slots 82 which include an open mouth 82 at one end of each slot and a closed area **82*b* at the opposite end of each slot. Each lock slide further includes an upwardly facing gear rack 84 and a downwardly directed flexible detent latch 86. The lock slides are slidably received in groove means 32 formed outside opposite sides 88 of housing part 24, as indicated by arrows "F" (FIG. 13). Latches 86 seat into a two-position detent means, generally designated 90, on the outside of walls 88. Each detent means include a first detent recess 90*a* which represents the unmated condition of the connector, and a second detent recess 90*b*** which represents the mated position of the connector, all as described below.

As seen in FIG. 1, mating housing 17 of the complementary connector includes a pair of side walls 92 each having a pair of inwardly directed cam followers or bosses 94. These cam followers ride in cam slots 82 of lock slides 30, as described below. Lastly, locking lever 40 includes a generally U-shaped handle 96 extending radially from a pair of hub portions 98 which have apertures 100 therethrough and which have arcuate gear segments 102 at the bottom thereof. Apertures 100 receive pivot pins 42 which project outwardly from side walls 88 of housing part 24, and arcuate gear segments 102 mesh with gear racks 84 of lock slides 30, again as described in detail below. The arcuate gear segments are concentric with apertures 100 and pivot pins 42.

Specifically, when connector 16, particularly housing part 24 of the connector, is mated with complementary connector housing 17, cam followers 94 enter mouths **82*a* of cam slots 82 of lock slides 30. In this unmated condition, detent latches 86 of the lock slides are located in detent recesses 90*a* on housing part 24 which represents the unmated positions of the lock slides. In this unmated condition of the connectors, locking lever 40 is in a relatively elevated position, i.e. a bight portion 104 of the U-shaped handle 96 is elevated above cover 38. When the handle is depressed in the direction of arrow "G" (FIG. 1), lock slides 30 are moved further in the direction of arrows "F" (FIG. 13) because of the meshed engagement of arcuate gear segments 102 on the lever with gear racks 84 on the lock slides. As the slides move in the direction of arrows "F", cam followers 94 of the complementary connector housing 17 ride up cam slots 82 to the closed ends 82*b* of the cam slots. Since the lock slides actually are the members which are moving transversely of the mating axis of the connectors, the mating connectors, in essence, are drawn toward each other to their mated condition as the lock slides are moved by depressing and rotating locking lever 40. In the fully mated condition of the connectors, detent latches 86 of lock slides 30 snap into detent recesses 90*b* on the outside of housing part 24** to define the fully mated condition of the connectors.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector which includes housing means having a plurality of terminal-receiving passages extending between a forward mating end of the housing means and a rear end thereof, a plurality of terminals received in the passages, a terminal position assurance device mounted on the housing means for movement between first and second positions only when all of the terminals are properly positioned in their respective passages, and a cover for securing to the housing means over at least a portion of the rear end thereof, wherein the improvement comprises:

means on the terminal position assurance device to prevent securing the cover to the housing means unless the terminal position assurance device is in said second position;

wherein said terminal position assurance device includes a first portion operatively associated with the terminals such that the device can move to its second position only when the terminals are properly positioned, and a second portion operatively associated with the cover such that the cover can be secured to the housing means only when the device is in its second position; and wherein said first portion of the terminal position assurance device comprises a plate slidably mounted on the housing means, the plate having a plurality of apertures through which the terminals extend.

2. In an electrical connector as set forth in claim 1, wherein said second portion of the terminal position assurance device comprises an arm projecting from said plate into a path of movement of the cover into securing position on the housing means when the device is in its position.

3. In an electrical connector which includes housing means having a plurality of terminal-receiving passages extending between a forward mating end of the housing means and a rear end thereof, a plurality of terminals received in the passages, a terminal position assurance device mounted on the housing means for movement between first and second positions only when all of the terminals are properly positioned in their respective passages, and a cover for securing to the housing means over at least a portion of the rear end thereof, wherein the improvement comprises:

means on the terminal position assurance device to prevent securing the cover to the housing means unless the terminal position assurance device is in said second position; and wherein said cover is secured to the housing means by rib means on the cover positionable into groove means on the housing means, and said terminal position assurance device includes means for blocking the groove means when the device is in its first position.

* * * * *